US008684858B2

(12) United States Patent
Gribovsky

(10) Patent No.: US 8,684,858 B2
(45) Date of Patent: Apr. 1, 2014

(54) PUTTING TRAINING AID

(76) Inventor: Vladimir Gribovsky, Waconia, MN (US)

( * ) Notice: Subject to any disclaimer, the term of this patent is extended or adjusted under 35 U.S.C. 154(b) by 0 days.

(21) Appl. No.: 13/568,401

(22) Filed: Aug. 7, 2012

(65) Prior Publication Data

US 2013/0059673 A1 Mar. 7, 2013

Related U.S. Application Data

(60) Provisional application No. 61/522,816, filed on Aug. 12, 2011.

(51) Int. Cl.
*A63B 69/36* (2006.01)

(52) U.S. Cl.
USPC ..... 473/257

(58) Field of Classification Search
USPC ..... 473/257, 266, 267, 268, 270, 279, 409
See application file for complete search history.

(56) References Cited

U.S. PATENT DOCUMENTS 1,410,811 A * 3/1922 Lewis ..... 473/267
D198,459 S * 6/1964 Blythe, Jr. ..... D21/791
3,917,278 A * 11/1975 Steinman, Jr. ..... 473/267
4,383,687 A * 5/1983 Wolff ..... 473/267
4,483,536 A * 11/1984 Mitchell ..... 473/268
5,116,058 A * 5/1992 Theriault ..... 473/268
5,174,576 A * 12/1992 Lee et al. ..... 473/267
5,486,003 A * 1/1996 Loew et al. ..... 473/267
7,985,145 B1 * 7/2011 Chu ..... 473/257
2003/0148815 A1 * 8/2003 Swistock ..... 473/257
2003/0148817 A1 8/2003 Swistock
2007/0243944 A1 * 10/2007 Paukune et al. ..... 473/267
2008/0102970 A1 5/2008 Park

OTHER PUBLICATIONS

The European Search Report for EP Application No. 12 19 2867 mailed Apr. 23, 2013 (5 pgs.).

* cited by examiner

*Primary Examiner* — Nini Legesse
(74) *Attorney, Agent, or Firm* — Dicke, Billig & Czaja, PLLC

(57) ABSTRACT

A putting training aid including an elongated golf stroke training device, a reflective mechanism a mounting mechanism. The elongated golf stroke training device has a first alignment line. The reflective mechanism has a second alignment line. The mounting mechanism holds the reflective mechanism with respect to the elongated golf stroke training device.

16 Claims, 4 Drawing Sheets

PUTTING TRAINING AID

REFERENCE TO RELATED APPLICATION

This application claims priority to U.S. Provisional Application No. 61/522,816, which was filed on Aug. 12, 2011, the contents of each of which are incorporated herein by reference.

FIELD OF THE INVENTION

The invention relates generally to devices used to improve the proficiency of golfing. More particularly, the invention relates to putting training aids.

BACKGROUND OF THE INVENTION

A variety of devices have been developed to enhance the proficiency of golfing in general and putting in particular. Depending upon the specific device, each may focus on one or more variables that enter into the putting stroke.

These variables can relate to body placement, such as the feet, shoulders, hips, hands and eyes in relation to the addressing of the ball. Further variables can relate to the striking force and the alignment and related eye-hand coordination pertaining to the backswing and follow through of the putting stroke.

The related complexity of the assembly varies depending upon the numbers of variables that the device attempts to correct through repetitive practice. Some of such devices provide prepared putting surfaces approximating the granularity of grass, which include practice holes. Some include electronic sensors to provide feedback about the stroke condition.

Some mimic the golf hole and provide a target hole that can be placed on a floor surface or in HVAC system registers to permit indoor practice. Some provide reflective mechanisms or magnetic indicators to assure certain head alignments. Others provide mechanical restraints to maintain arm, wrist and/or hand position to the putter.

Many assemblies also exist to assure a squared alignment of the putter head to the ball during and through the putting stroke motion. Some provide mechanical gauges and reflective mechanisms whereby the golfer is able to monitor head motion over the stroke. Some provide a guide surface, which the putter shaft follows to assure an aligned, squared travel motion.

Although a repetitive motion can be practiced with many of the latter devices, a deficiency exists in that the golfer does not have the benefit of the feedback of the ball travel to confirm the proper stroke motion.

Consequently, repetitive practice can merely result in a learned stroke, but which does not provide accurate results. Preferably, a training device should permit a normal stroke motion, while allowing the golfer to monitor selected portions of the motion and obtain a feedback of the resultant effect on ball travel.

One aspect of putting that has been recognized as being important to making puts is striking the golf ball with a proper putter orientation and swing such that the golf ball travels in a substantially straight line.

One such device is disclosed in Kueng et al., U.S. Pat. No. 5,409,231, which discloses an elongated golf stroke training device. The golf ball is positioned on the golf stroke training device and then struck with a putter where the goal is for the golf ball to roll along the golf stroke training device to an end of the device that is opposite the initial position of the golf ball.

In appreciation of the foregoing shortcomings, the present invention was developed to provide an assembly that allows a golfer to monitor initial positioning as well as stroke motion during the backswing motion, to assure the putter head is square to the ball, and to confirm a straight line ball travel in relation to an elongated travel path. A controlled, consistent backswing and follow through with corresponding putting accuracy are thereby obtained.

SUMMARY OF THE INVENTION

An embodiment of the invention is directed to a putting training aid having a reflective material attached thereto. The putting training aid is adapted for use in conjunction with an elongated golf stroke training device. The putting training aid enables a user to accurately position eyes directly over the golf ball to thereby increase accuracy when putting.

Another embodiment of the invention is directed to a putting training aid including an elongated golf stroke training device, a reflective mechanism and a mounting mechanism. The elongated golf stroke training device has a first alignment line. The reflective mechanism has a second alignment line. The mounting mechanism holds the reflective mechanism with respect to the elongated golf stroke training device.

Another embodiment of the invention is directed to a method of using a putting training aid. An elongated golf stroke training device is provided. The elongated golf stroke training device has a first alignment line.

A reflective mechanism is positioned with respect to the elongated golf stroke training device. The reflective mechanism has a second alignment line. The reflective mechanism is oriented so that at least a portion of the elongated golf stroke training device is visible in the reflective mechanism.

A golf ball is positioned on the elongated golf stroke training device. The first alignment line is aligned with the second alignment line by moving with respect to the elongated golf stroke training device.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE PREFERRED EMBODIMENTS

Figure 2:
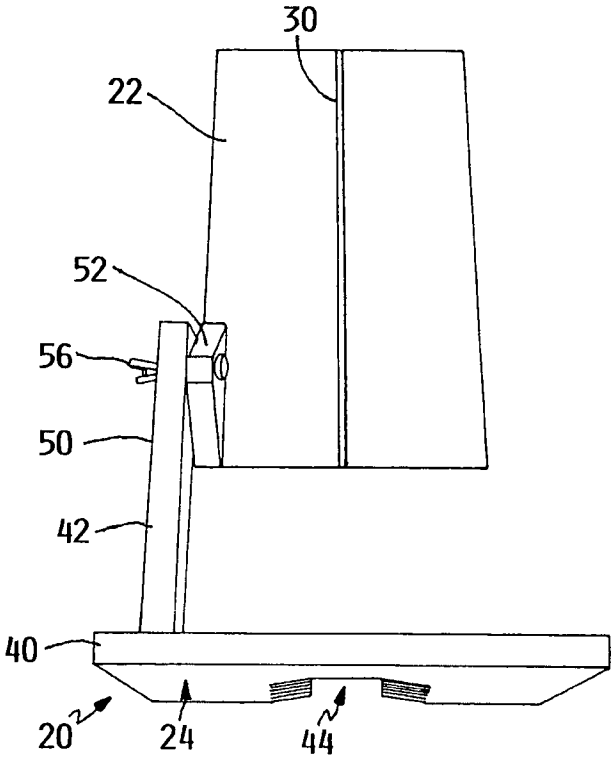
FIG. 2 is a front view of the putting training aid of FIG. 1.
Figure 1:
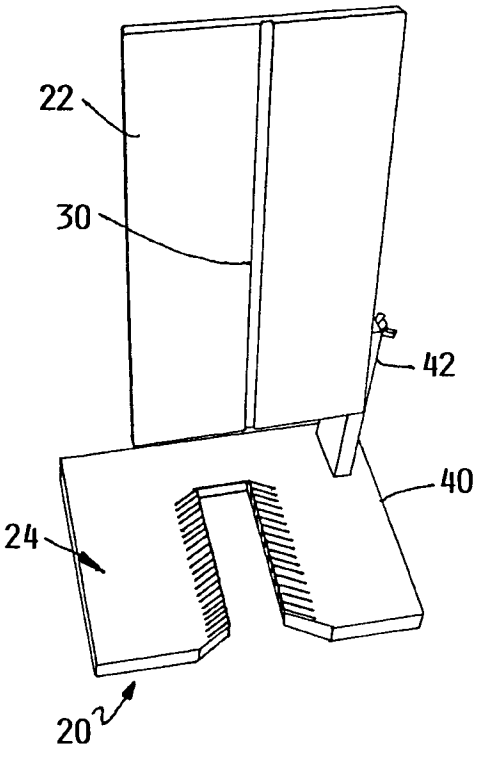
FIG. 1 is a perspective view of a putting training aid according to an embodiment of the invention.
Figure 4:
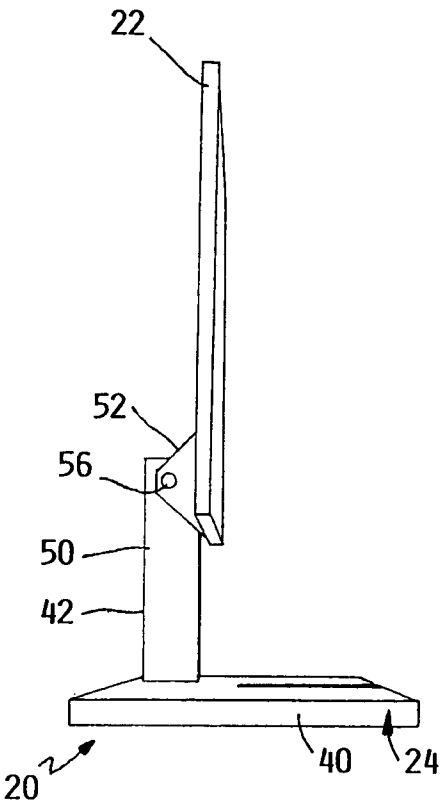
FIG. 4 is a second side view of the putting training aid of FIG. 1.
Figure 3:
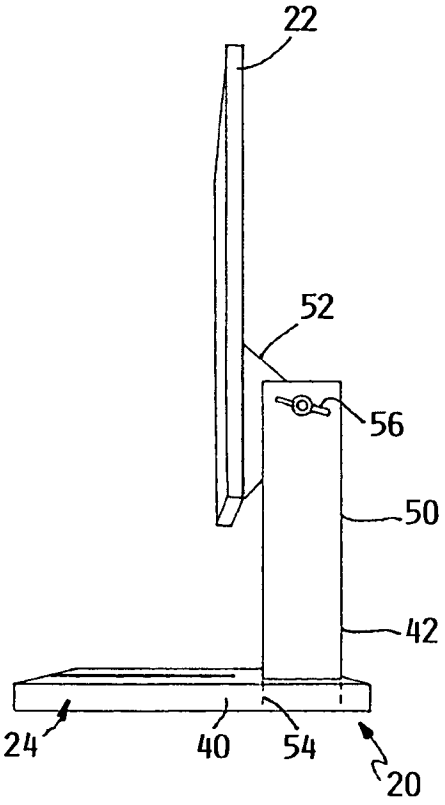
FIG. 3 is a first side view of the putting training aid of FIG. 1.

An embodiment of the invention is directed to a putting training aid that enhances the ability of a golfer to accurately position with respect to a golf ball when putting. The putting training aid 20 generally includes a reflective mechanism 22 and a mounting mechanism 24, as illustrated in the figures.

The reflective mechanism 22 may be fabricated from a variety of materials that provide a relatively high level of reflectivity. In certain embodiments, the reflective mechanism 22 may be a mirror. The reflective mechanism 22 may be fabricated from a plastic material that resists breaking to a greater extent than reflective mechanisms fabricated from glass.

The reflective mechanism 22 may include a second alignment line 30 that is used during the alignment process. The second alignment line 30 may be oriented in a generally vertical direction. The second alignment line 30 may extend at least partially between a lower edge 32 of the reflective mechanism 22 and an upper edge 34 of the reflective mechanism 22. In certain embodiments, the second alignment line 30 extends substantially between the lower edge 32 and the upper edge 34.

Figure 6:
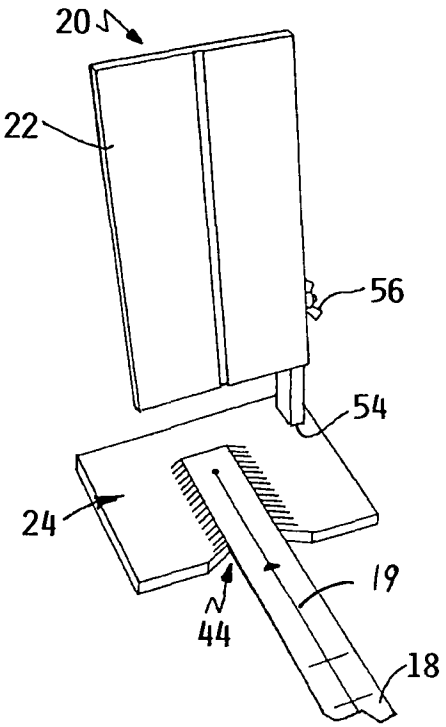
FIG. 6 is a perspective view of the putting training aid used in conjunction with a golf stroke training device.
Figure 5:
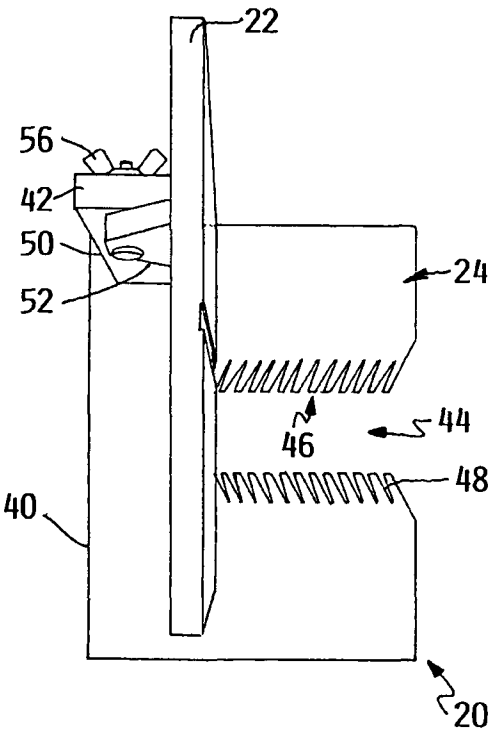
FIG. 5 is top view of the putting training aid of FIG. 1.
Figure 8:
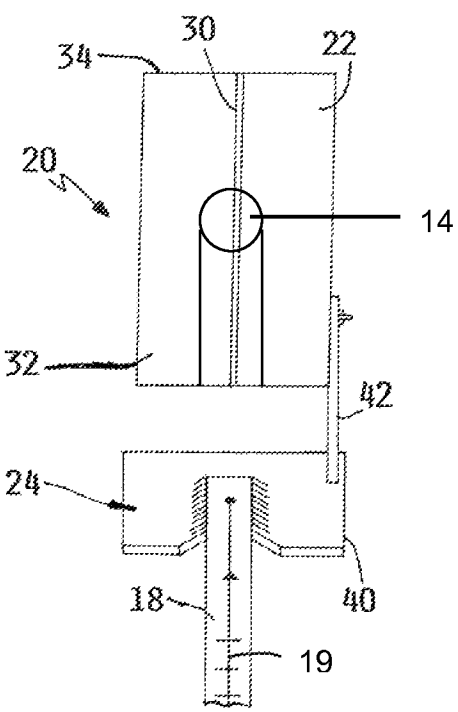
FIG. 8 is a side view of the putting training aid being used to align a position of a person using the putting training aid.
Figure 7:
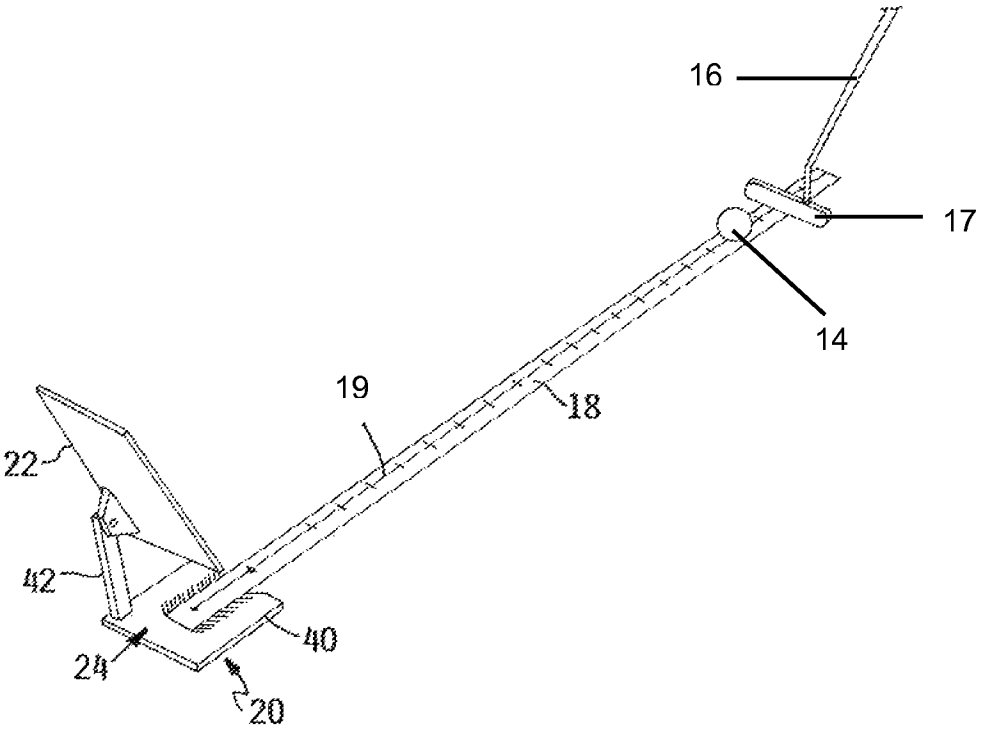
FIG. 7 is another perspective view of the putting training aid used in conjunction with the golf stroke training device.

The second alignment line 30 may have a width that is sufficiently large to enable the second alignment line 30 to be readily seen by the golfer using the putting training aid 20. However, the second alignment line 30 should not be too wide so that the second alignment line 30 restricts the ability to see the golf stroke training device 18 during the alignment process as well as the first alignment line 19 on the golf stroke training device 18. The first alignment line is intermediate side edges of the elongated golf stroke training device 18, as illustrated in FIGS. 6-8. In certain embodiments, the second alignment line 30 may have a width of up to about ½ of an inch. In other embodiments, the second alignment line 30 may have a width of about ⅛ of an inch or less as long as the golfer can see the line and the golf ball. While the figures illustrate that the second alignment line 30 is substantially complete, the second alignment line 30 may be fabricated in other configurations such as being a dashed line.

The reflective mechanism 22 may have a height that is greater than a width. Forming the reflective mechanism with these dimensions enhances the ability of the golfer to obtain an accurate alignment while also enabling the putting training aid 20 to have a compact configuration when not being used.

In certain embodiments, the reflective mechanism 22 has a height of between about 2 inches and about 10 inches. In other embodiments, the reflective mechanism 22 has a height of between about 4 inches and about 6 inches.

In certain embodiments, the reflective mechanism 22 has a width of between about 1 inch and about 6 inches. In other embodiments, the reflective mechanism 22 has a width of between about 3 inches and about 4 inches.

The mounting mechanism 24 may generally include a base 40 and an arm assembly 42 that extends from the base 40. The base 40 may have a length and a width that are sufficiently large to support the reflective mechanism 22 in a desired position and thereby reduce the likelihood of the putting training device tipping over once positioned. However, the base 40 should be sufficiently small to facilitate storage of the putting training aid 10 when not in use.

In certain embodiments, the base 40 may have a generally square or rectangular configuration. The base 40 may have a length and a width that are both between about 3 inches and about 10 inches. In other embodiments, the base has a length and a width that are both between 3 inches and about 5 inches.

The base 40 may be fabricated with a height that is about the same as the height of the golf stroke training device 18 that is used in conjunction with the putting training aid 20. In certain embodiments, the height of the base 40 may be between about ¼ of an inch and about ½ of an inch.

The base 40 may be formed with a recess 44 that extends from an edge of the base 40 towards a central portion of the base 40. The recess 44 may have a width that is approximately the same as a width of the golf stroke training device 18 that is used in conjunction with the putting training aid 20. In certain embodiments, the recess 44 has a width of between about ½ of an inch and about 2 inches.

The base 40 may be fabricated with a retention device 46 located proximate the recess 44 that is used to retain the golf stroke training device 18 in a stationary position with respect to the putting training aid 20. The retention device 46 may include a plurality of fingers 48 mounted along both sides of the recess 44.

The fingers 48 may be fabricated from a material that allows the fingers 48 to deflect when the golf stroke training device 18 is inserted into the recess 44. The fingers 48 thereby engage the sides of the golf stroke training device 18. When the golf stroke training device 18 is formed with a width that is approximately the same as a width of the recess 44, the fingers 48 do not have to deflect very far when the golf stroke training device 18 is inserted into the recess 44.

A force by which the fingers 48 engage the sides of the golf stroke training device 18 is sufficiently large so that the golf stroke training device 18 resists movement with respect to the base 40 during use of the putting training aid 20. However, the force should not be too large so that the golf stroke training device 18 may be separated from the putting training aid 20 when not in used.

The fingers 48 be fabricated from the same material that is used to fabricate the other portions of the base 40. Using such a configuration minimizes the potential that the fingers 48 would become separated from the base 40.

In another configuration, the retention device comprises at least one screw (not shown) that extends through the base 40. The screw is capable of extending into the recess 44 to engage the elongated golf stroke training device 18 to thereby retain the elongated golf stroke training device 18 in a stationary position with respect to the base 40.

In another embodiment, sides of the recess 44 each have a channel (not shown) formed therein. An end of the elongated golf stroke training device 18 may include an extension (not shown) that extends from the sides thereof proximate the end of the elongated golf stroke training device 18 that engages the base 44.

This configuration enables the elongated golf stroke training device 18 to slide into engagement with the base 44. A person of skill in the art will appreciate that the configuration may be reversed.

The arm assembly 42 operably attaches the reflective mechanism 22 to the base 40. The arm assembly 42 may include a first arm portion 50 and a second arm portion 52. The first arm portion 50 may be oriented substantially transverse to the base.

In certain embodiments, the base 40 has an aperture 54 formed therein having a width and a length that are approximately the same as the width and the thickness of the first arm portion 50. Using such a configuration enables the first arm portion 50 to frictionally engage the base 40.

The second arm portion 52 may be attached to the reflective mechanism 22. In one such configuration, the second arm portion 52 is attached to a surface of the reflective mechanism 22 using an adhesive, a fastener or combination thereof.

A fastening mechanism 56 may be used to operably attach the first arm portion 50 to the second arm portion 52. The fastening mechanism 56 should enable the reflective mechanism 22 to be pivoted with respect to the base 40 so that the reflective mechanism 22 may be aligned based upon factors such as the height of the golfer who is using the putting training aid 20.

In one such configuration, the fastening mechanism 56 is a screw and a wing nut. Using such a configuration enables the fastening mechanism 56 to be adjusted without the use of tools.

In operation, the golf stroke training device 18 is attached to the putting training aid 20 so that an upper surface of the golf stroke training device 18 is generally aligned with an upper surface of the putting training aid 20.

The golf stroke training device 18 is leveled so that the sides of the golf stroke training device 18 are at approximately the same height. In certain embodiments, leveling may be performed using a leveling mechanism that is incorporated into at least one of the golf stroke training device 18 and the putting training aid 20.

While side-to-side leveling of the golf stroke training device 18 is an important factor in setting up the invention, the golf stroke training device 18 should be relatively level with respect to the direction between opposite ends of the golf stroke training device 18.

Next, the reflective mechanism 22 is oriented so that when the golfer is standing adjacent to an end of the golf stroke training device 18 that is distal the putting training aid 20 so that the golfer may see at least a portion of the golf stroke training device 18 in the reflective mechanism 22 when in a position that is typically used when putting. This aspect enables the invention to be used by golfers having various heights.

A golf ball 14 is positioned in a starting location on the golf stroke training device 18 as illustrated in FIG. 7. The golfer grasps the putter 16 and positions a head 17 of the putter 16 proximate to the golf ball 14.

The golfer then turns his/her head to look towards the reflective mechanism 22. If the second alignment line 30 is not aligned with a center of the golf stroke training device 18, the golfer moves his/her feet towards or away from the golf stroke training device 18 until the second alignment line 30 is aligned with the first alignment line 19 on the golf stroke training device 18, as illustrated in FIG. 8. As illustrated in FIG. 7, the first alignment line 19 is oriented to extend between a first end and a second end of the golf stroke training device 18. Since the golf ball 14 is placed on the golf stroke training device 18 intermediate side edges thereof, as illustrated in FIG. 7, aligning the second alignment line 30 with the center of the golf stroke training device 18 causes the second alignment line 30 to be aligned with the center of the golf ball 14, as illustrated in FIG. 8.

The golfer then swings the putter 16 with the goal of having the golf ball 14 roll along an upper surface of the golf stroke training device 18 until the distal end of the golf stroke training device 18. This process may be repeated using additional golf balls 14 to enhance the ability of the golfer to feel when the golfer's body is in an optimum position with respect to the golf ball 14.

The invention provides a golfer with instant feedback in a variety of areas that are important to success. The golfer can determine whether his or her eyes are directly over the golf ball at the start of the golf stroke. The golf can monitor whether the golf club is moving straight on the back swing as opposed to moving inside or outside. The golfer can monitor whether the golf club has accelerated when moving the golf club into contact with the golf ball.

The golfer can determine the orientation of the golf club face when the golf club contacts the golf ball. The golf club face should be oriented straight with respect to the golf ball. If the golf club face is in an open orientation, the golf ball will roll off the elongated golf stroke training device 18 to the right. If the golf club face is in a closed orientation, the golf ball will roll off the elongated golf stroke training device to the left. The preceding comments are with respect to a right handed golfer. The movement of the golf ball would be opposite what is described above for a left handed golfer.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A putting training aid comprising:

an elongated golf stroke training device having a first alignment line;

a reflective mechanism having a second alignment line; and a mounting mechanism for holding the reflective mechanism with respect to the elongated golf stroke training device, wherein the mounting mechanism comprises:

a base having a recess formed therein from at least one edge thereof, wherein the recess is adapted to receive a portion of the elongated golf stroke training device and wherein the base further comprises a retention device that is capable of engaging the elongated golf stroke training device to retain the elongated golf stroke training device in a stationary position with respect to the base; and an arm that extends from the base, wherein the reflective mechanism is attached to an end of the arm that is opposite the base.

2. The putting training aid of claim 1, wherein the second alignment line is oriented in a generally vertical direction.

3. The putting training aid of claim 1, wherein the second alignment line extends substantially between the upper edge and the lower edge.

4. The putting training aid of claim 1, wherein the second alignment line is no wider than the first alignment line.

5. The putting training aid of claim 1, wherein a height of the reflective mechanism is greater than a width of the reflective mechanism.

6. The putting training aid of claim 1, wherein a width of the reflective mechanism is greater than a width of the elongated golf stroke training device.

7. The putting training aid of claim 1, wherein the first alignment line is intermediate side edges of the elongated golf stroke training device.

8. The putting training aid of claim 7, wherein the retention device comprises a plurality of the fingers and wherein the fingers are deflectable from an initial configuration to a deflected configuration.

9. The putting training aid of claim 1, wherein the arm is pivotally mounted with respect to the base for pivoting between a use configuration and a storage configuration and wherein when in the storage configuration, the arm is oriented substantially parallel to the base.

10. The putting training aid of claim 1, and further comprising a leveling mechanism operably attached to at least one of the elongated golf stroke training device and the base, wherein the leveling mechanism is capable of evaluating whether the elongated golf stroke training device is level in at least one direction.

11. A method of using a putting training aid comprising:

providing an elongated golf stroke training device having a first alignment line;

positioning a reflective mechanism with respect to the elongated golf stroke training device, wherein the reflective mechanism has a second alignment line that extends between an upper edge and a lower edge of the reflective mechanism;

orienting the reflective mechanism so that at least a portion of the elongated golf stroke training device is visible in the reflective mechanism;

positioning a golf ball on the elongated golf stroke training device; and aligning the first alignment line and the second alignment line by moving with respect to the elongated golf stroke training device.

12. The method of claim 11, and further comprising leveling the elongated golf stroke training device so that sides of the elongated golf stroke training device are at approximately a same height.

13. The method of claim 11, and further comprising:

positioning a golf club head that is proximate a distal end of the golf club in proximity to the golf ball;

viewing an orientation of the golf club head with respect to at least one of the golf ball and the elongated golf stroke training device; and changing an orientation of the golf club head with respect to the golf ball.

14. The method of claim 11, and further comprising:

moving a golf club with respect to the golf ball; and viewing the movement of the golf club using the reflective mechanism.

15. The method of claim 14, wherein viewing the movement of the golf club comprises:

viewing the golf club moving away from the golf ball on a back swing; and viewing the golf club moving toward the golf ball on a swing.

16. A putting training aid comprising:

an elongated golf stroke training device having a first alignment line that is oriented to extend between a first end and a second end of the elongated golf stroke training device;

a reflective mechanism having a second alignment line; and a mounting mechanism for holding the reflective mechanism with respect to the elongated golf stroke training device, wherein the mounting mechanism comprises:

a base having a recess formed therein from at least one edge thereof, wherein the recess is adapted to receive the first end of the elongated golf stroke training device, wherein the base further comprises a retention device that is capable of engaging the elongated gold stroke training device to retain the elongated golf stroke training device in a stationary position with respect to the base and wherein the retention device comprises a plurality of fingers and wherein the fingers are deflectable from an initial configuration to a deflected configuration; and an arm that extends from the base, wherein the reflective mechanism is attached to an end of the arm that is opposite the base.

* * * * *